United States Patent [19]

Lockard

[11] 4,095,074

[45] June 13, 1978

[54] SWITCH FOR CARD EDGE

[75] Inventor: Joseph LaRue Lockard, Harrisburg, Pa.

[73] Assignee: AMP Incorporated, Harrisburg, Pa.

[21] Appl. No.: 731,076

[22] Filed: Oct. 12, 1976

[51] Int. Cl.[2] ..... H01H 1/22; H01H 19/50; H01H 21/04

[52] U.S. Cl. ..... 200/295; 200/303; 200/244; 200/51.11; 200/6 C

[58] Field of Search ..... 200/293, 295, 296, 258, 200/250, 244, 155 R, 153 N, 51.12, 51.11, 51 R, 6 R, 6 B, 6 BB, 6 C, 303

[56] References Cited

U.S. PATENT DOCUMENTS

| | | | |
|---|---|---|---|
| 3,019,323 | 1/1962 | Daniels | 200/155 R |
| 3,395,378 | 7/1968 | Ericson | 200/51 R X |
| 3,953,699 | 4/1976 | Scheibel et al. | 200/295 |
| 4,024,362 | 5/1977 | Morgan et al. | 200/296 X |

*Primary Examiner*—William Price
*Assistant Examiner*—Steven M. Pollard
*Attorney, Agent, or Firm*—Gerald K. Kita

[57] ABSTRACT

A miniature manually actuated switch is grippingly received over an edge of a printed circuit board or card and has a selector for selectively bridging circuit paths on opposite sides of the card. Electrical contacts with the selector captivated there between are resiliently biased into positive gripping relationship on the card.

2 Claims, 3 Drawing Figures

SWITCH FOR CARD EDGE

The present invention relates to a manually actuated miniature switch resiliently gripping the edge of a printed circuit card. The switch housing itself resiliently grips the card edge together with electrical contacts which also grip the card edge and engage corresponding circuit paths on opposite sides of the card. Interposed between opposite ends of the contacts is a manually actuated selector in the form of a rotor which resiliently biases apart the contact free ends, the resilient bias being transferred to bias opposite ends of the contacts into positive gripped relationship on the card edge. A positive stop for the card edge is provided for in the housing. Also the housing is so constructed and arranged to prevent twisting when in gripped relationship on the card edge. Resiliently yieldable solid hinges are formed in the housing to augment the housing gripping pressure on the card edge.

Accordingly, it is an object of the invention to provide a miniature switch for gripping the edge of a printed circuit card and for selectively connecting a circuit path on one side of the card with a circuit path on the other side.

Another object of the present invention is to provide a switch for bridging one circuit path of a printed circuit card selectively to a circuit path on the other side of the card by a miniature switch having both a housing and also electrical contacts which grip the card, the switch further having a manually actuated rotor disposed between the contacts to augment gripping pressure of the contacts on the card.

Another object of the present invention is to provide a switch wherein the housing thereof resiliently grips opposite sides of the printed circuit card the edge of which is received in the housing and seated against a positive stop, the housing being so constructed and arranged to prevent twisting or buckling when portions of the housing are pivoted about resiliently yieldable hinges formed in the housing.

Other objects and many advantages of the present invention will become apparent from the following detailed description taken in conjunction with the drawing.

In the drawing,

FIG. 2 illustrating an on position of the switch and FIG. 3 illustrating an off position.

Figure 2:
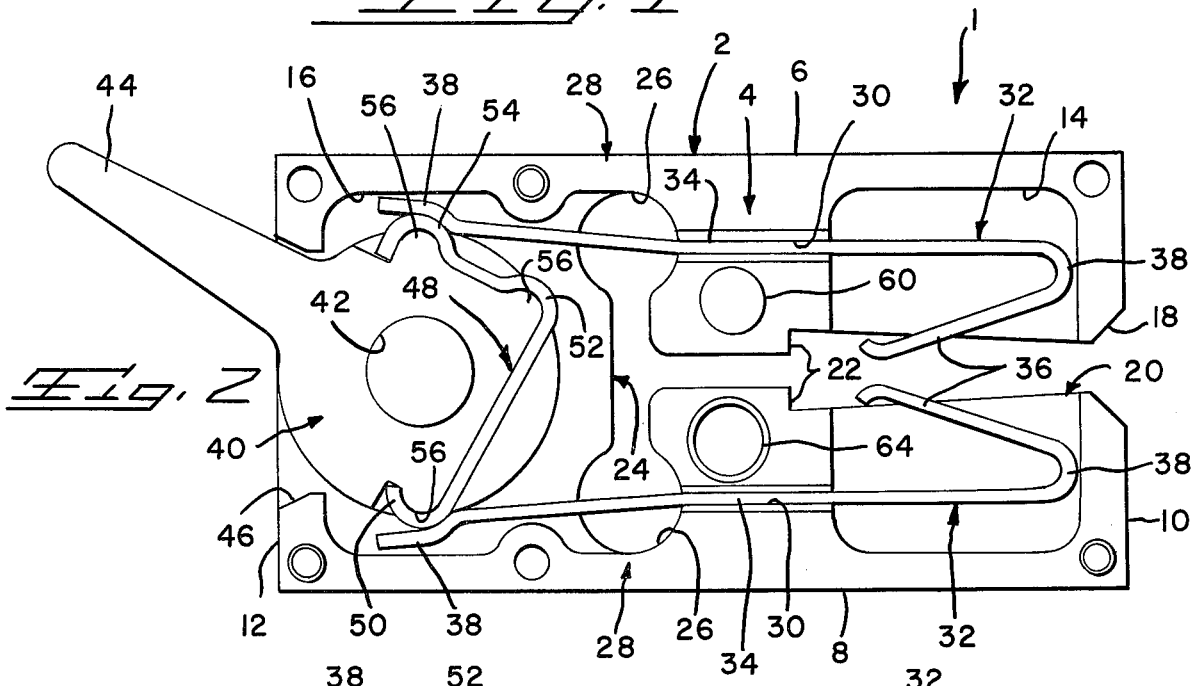
FIGS. 2 and 3 are greatly enlarged elevations of the switch illustrated in FIG. 1 with portions removed to illustrate the details thereof.
Figure 3:
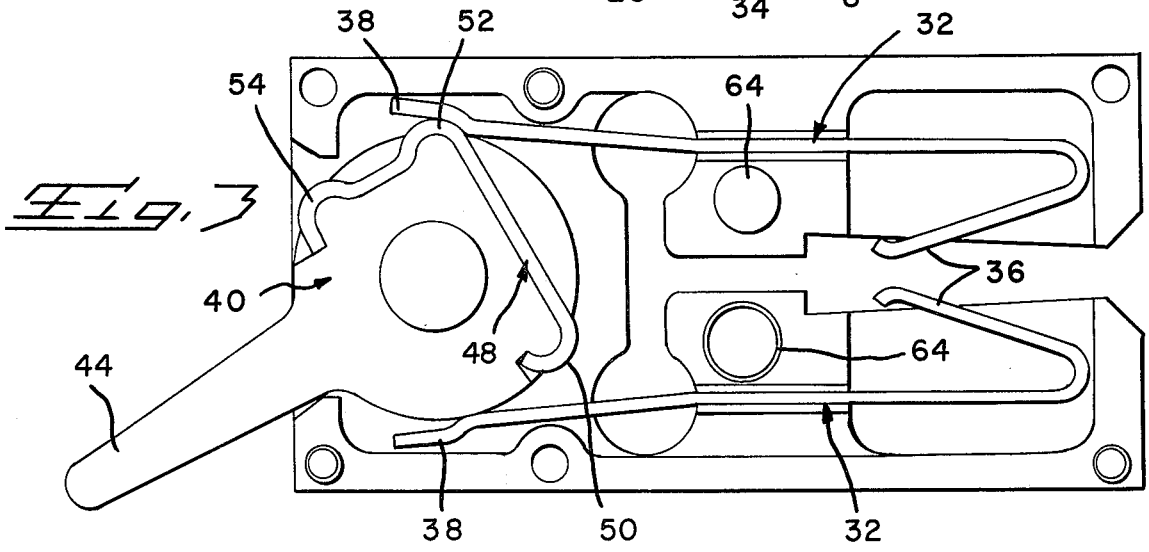

In the following detailed description reference will be made to the drawing figures, and more specifically to FIGS. 2 and 3. The switch according to the present invention is generally illustrated at 1 having twin housing portions 2 and 2' which are mirror images of each other, thus only housing portion 2 will be described in detail. FIGS. 2 and 3 illustrate the switch of FIG. 1 with the housing portion 2' removed to illustrate the interior details of the housing portion 2. The housing portion 2 is generally of rectangular block form molded from a relatively rigid dielectric material with its mating face 4 exposed, the mating face being that which contacts a corresponding mating face of the housing portion 2'. The housing portion 2 includes side walls 6 and 8 and end walls 10 and 12. The mating face 4 is provided with a recess 14 which is adjacent to the end wall 10. The recess 14 has rounded corners and is within the confines of the end wall 10 and the corresponding side walls 6 and 8. Mating face 4 is provided with another recess 16 adjacent to, but within the confines of, the end wall 12, and also within the confines of the side walls 6 and 8. The end wall 10 is provided with a flared entryway 18 opening into one end of an elongated slot generally indicated at 20 which is parallel with the side walls 6 and 8. The slot 20 is abruptly widened at stepped shoulders 22 located deeply within the housing portion 2. The width of the slot then tapers considerably from the step shoulders 22 toward the flared entryway 18. Slot 20 intersects a second slot 24 generally illustrated at 24 which is transversely of the slot 20 and forms a generally T-shaped configuration therewith. Each end of the slot 24 terminates in an enlarged arcuate relieved portion 26 adjacent to the corresponding side walls 6 and 8. As shown the slot 24 and the arcuate portions 26 thereof are within the confines of the recess 16 and define relatively reduced solid neck portions 28 coincident with the side walls 6 and 8. The neck portions 28 define stiffly resilient solid hinges. The slot 20 bifurcates a considerable length of the housing from the end wall 10 to the slot 24, thereby defining housing finger portions which are pivotable about the hinges 28 toward and away from each other into gripped relationship on a printed circuit card. Each of the defined finger portions has a longitudinal groove portion 30 parallel to the longitudinal axis of the slot 20 and communicating with the recesses 14 and 16. The switch further includes electrically conducting spring contacts generally shown at 32 which are mirror images of each other; and each of which includes a longitudinal portion 34 mounted within a corresponding groove 30. The width of each longitudinal portion 34 is generally greater than that of the depth of the groove 30 such that each longitudinal portion 34 projects outwardly of the groove 30 and is received in a corresponding groove of the mirror image cover portion 2' which is superposed on the mating face 4 of the housing portion 2. Each contact 32 has a first free end 36 doubled back on itself to form a bight 38. Each free end 36 accordingly is in the form of a cantilever spring disposed within the corresponding recess 14 and projecting diagonally to intersept the slot 20. The opposite free ends 38 of the contacts 32 are slightly diverging and are disposed within the recess 16. Each of the ends is formed with a crook. The manually actuatable switch selector or rotor 40 is rotatedly mounted over an axle 42 supported at one end in the housing portion 2 and at its other end in the housing portion 2'. The rotor is generally circular and includes a projecting lever 44 which projects outwardly through an enlarged opening 46 in the end 12. The rotor 40 as mounted thereon an electrical bridging contact generally indicated at 40. Contact 40 is fabricated of metal strip having three arcuate portions 50, 52 and 54 formed serially along the length of the strip. The arcuate portions conform to and are mounted over complimentary arcuate portions 56 molded integral with the rotor 40. The arcuate portions 50, 52 and 54 of the contact 48 project outwardly beyond the circular periphery of the rotor. With the rotor in its position as shown in FIG. 2 the bridging contact 48 has its circular or arcuate portions 50 and 54 detented in and engaging the crook of the contact free ends 38. With the contact 48 interposed between the free ends 38, the free ends 38 are biased resiliently outward to insure a good electrical contact pressure on the carriage contact 48. The outward resilient bias of the free ends 38 is transferred longitudinally of the contacts 32 to the opposite ends 36 tending to bias or pivot the ends 36 inwardly into positive gripped relationship on opposite sides of a card. Thus when the printed circuit card edge is inserted between the free ends 36 the gripping pressure of the contacts 36 on opposite sides of the card is augmented by the presence of the contact 48 interposed between the free ends 38.

In the position of the rotor 40 shown in FIG. 3 the arcuate portion 52 of the carriage contact 48 will be detented in the crook of one contact free end 38. The other contact free end 38 will be impinged against the circular periphery of the rotor 40. Thus with the rotor 40 and its contact 48 interposed between the free ends 38, the free ends 38 will be biased resiliently outward of each other with the resilient bias being transferred longitudinally of the contacts 32 and tending to bias or pivot the contact free ends 36 toward each other thereby enhancing the gripped relationship of the contact free ends 36 on the card.

Figure 1:
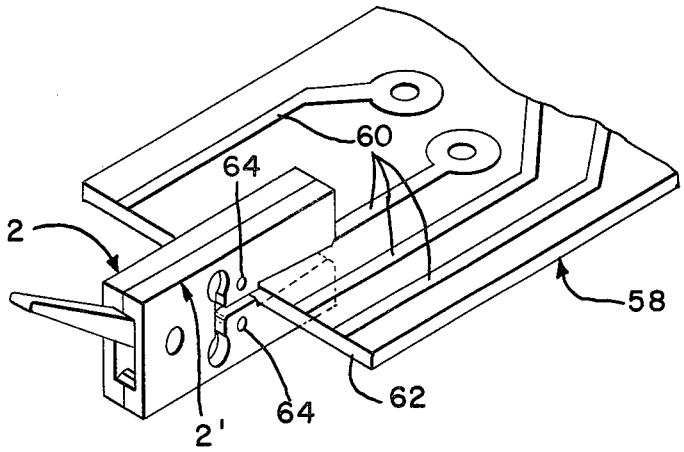
FIG. 1 is an enlarged fragmentary perspective of a switch according to the present invention in position over a printed circuit card edge.

FIG. 1 illustrates a printed circuit board or card 58 having plated paths 60 on one side or surface thereof. Additional plated circuit paths 60 are disposed on the opposite surface (not shown) of the card 58. An edge 62 of the card is received longitudinally within the slot 20 until it stops against the shoulders 22. The contact free ends 36 resiliently grip the card therebetween, and overlie and consequently electrically engage the corresponding circuit paths 60 on each of the top and bottom sides or surfaces of the card. Connection of a plated path on one side of the board and plated path on the other side of the board is accomplished when the switch rotor is in its position shown in FIG. 2. Interruption of such communication between the circuit paths is accomplished when the rotor is actuated manually to its position shown in FIG. 3. The elongated contacts 32 are effectively doubled ended electrical receptacles wherein the resilient grip on the card by the receptacle formed by the cooperating free ends 36 transfers gripping pressure to the receptacle formed by the cooperating free ends 38 enhancing the gripping pressure of the free ends 38 on the carriage contact 48 or upon the periphery or the rotor 40 as shown in FIG. 3. Likewise the outward resilient bias of the free ends 38 on the contact 48 and rotor 40 are transferred along the contacts to enhance the gripping pressure between the free ends 36 on the card edge. Further the housing portion 2 grips the opposite sides or surfaces of the card 58 at the narrowest portion of the slot 20 which is located at the flared entryway 18. The card edge is force fit within such opening thereby resiliently spreading apart or deflecting the bifurcated housing portions on either side of the slot 20. The housing portions pivot because of resilient yielding or flexure at the neck portions 28, the arcuate slot portions 26 preventing stress concentration as a result of such resilient yielding. Because the housing portion 2 cooperates with a mirror image housing portion 2' to form an enclosure for the contacts 32, the carriage contact 48 and the rotor 40 the completed housing has considerable width adjacent the card edge receiving slot 20. More particularly the two halves of the housing are joined together by rivets 64 adjacent the card edge slot 20 to insure mutual support as between the bifurcated housing portions and coaction in unison of the housing portions when resiliently deflected upon receipt of a card in the slot 20. Such mutual support and coaction prevents twisting or buckling of the housing.

The contact free ends 36 tend to be biased toward each other as described independently of pivotal motion of said housing finger portions. Insertion of a card in the slot 20 will cause pivoting of the housing finger portions outwardly away from each other, but to a degree insufficient to reduce gripping pressure on the contact free ends 36.

Although a preferred embodiment to the present invention is described and illustrated other modifications and embodiments thereof are intended to be covered by the spirit and scope of the claims.

What is claimed is:

1. A switch for mounting on a printed circuit board edge, comprising:

A housing having a first end bifurcated by a first slot with shoulders on opposite sides of said first slot for abuttingly receiving an edge of a printed circuit board, said first slot tapering from said shoulders toward said first end to grippingly receive opposite sides of a printed circuit board inserted into said first slot and stopped against said shoulders, a second slot extending transversely of said first slot and forming together with said first slot a T-shaped opening, each end of said second slot terminating in enlarged circular apertures adjacent corresponding side walls of said housing, said circular apertures defining resiliently yieldable hinge portions integral with said side walls allowing resilient deflection of said bifurcated housing away from said first slot in response to enlargement of said first slot by the presence therein of a printed circuit board, a rotor mounted for rotation in said housing and carrying a bridging contact, a pair of elongated conducting spring contacts mounted in said housing lengthwise of said first slot and having first end portions protruding into said slot from opposite sides thereof, said rotor being mounted between spaced apart second end portions of the said spring contacts continuously biasing said second end portions resiliently away from each other and thereby pivoting said first ends of said spring contacts toward each other independently of pivotable motion of said housing side walls, a lever on said rotor for manually rotating said rotor to a first position bridging said bridging contact electrically across said spring contacts and said rotor being rotatable to a second position disengaging said bridging contact from at least one of said spring contacts.

2. The structure as described in claim 1, wherein said housing is bifurcated axially along both said first and second slots such that each half of said housing is provided with a T-shaped section of said T-shaped opening, and a pair of rivets connecting each housing together at a location between said second slot and the corresponding stepped shoulder to insure flexure of said housing halves in unison as said side walls are yieldably pivoted in response to receipt of a printed circuit board in said first slot.

* * * * *